US009358422B2

(12) United States Patent
Brontman

(10) Patent No.: US 9,358,422 B2
(45) Date of Patent: Jun. 7, 2016

(54) TREADMILL SYSTEM WITH ROTATABLE EXERCISE PLATFORM

(71) Applicant: Yuval Brontman, New York, NY (US)

(72) Inventor: Yuval Brontman, New York, NY (US)

( * ) Notice: Subject to any disclaimer, the term of this patent is extended or adjusted under 35 U.S.C. 154(b) by 0 days.

(21) Appl. No.: 14/718,984

(22) Filed: May 21, 2015

(65) Prior Publication Data

US 2015/0335945 A1 Nov. 26, 2015

Related U.S. Application Data

(60) Provisional application No. 62/001,410, filed on May 21, 2014.

(51) Int. Cl.

| | |
|---|---|
| ***A63B 22/00*** | (2006.01) |
| ***A63B 22/14*** | (2006.01) |
| ***A63B 22/02*** | (2006.01) |
| ***A63B 23/04*** | (2006.01) |
| ***A63B 24/00*** | (2006.01) |
| ***A63B 71/06*** | (2006.01) |

(52) U.S. Cl.

CPC ..... *A63B 22/14* (2013.01); *A63B 22/00* (2013.01); *A63B 22/0023* (2013.01); *A63B 22/0242* (2013.01); *A63B 22/0285* (2013.01); *A63B 23/04* (2013.01); *A63B 24/0062* (2013.01); *A63B 24/0087* (2013.01); *A63B 71/0619* (2013.01); *A63B 2024/009* (2013.01); *A63B 2024/0065* (2013.01)

(58) Field of Classification Search

USPC ..... 482/8, 9, 51, 54

See application file for complete search history.

(56) References Cited

U.S. PATENT DOCUMENTS

| | | | | |
|---|---|---|---|---|
| 3,281,964 | A * | 11/1966 | Hewes | B64G 7/00 434/34 |
| 5,507,044 | A * | 4/1996 | Williamson | A61G 7/1019 5/507.1 |
| 6,568,646 | B2 * | 5/2003 | Wess | A61G 5/10 108/139 |
| 7,165,276 | B2 * | 1/2007 | Hahn | A61G 7/1038 5/81.1 R |
| 8,206,230 | B2 * | 6/2012 | Magpuri | E04H 3/22 434/55 |
| 8,734,301 | B2 * | 5/2014 | Remelius | A63B 22/0235 198/388 |
| 2009/0111670 | A1 | 4/2009 | Williams | |
| 2015/0321337 | A1 * | 11/2015 | Stephens, Jr. | B25J 3/00 700/257 |

FOREIGN PATENT DOCUMENTS

| | | | |
|---|---|---|---|
| KZ | 24424 | B | 8/2011 |
| RU | 109979 | U1 | 11/2011 |
| SU | 1741824 | A1 | 6/1992 |

OTHER PUBLICATIONS

PCT International Search Report issued on Oct. 22, 2015.

* cited by examiner

*Primary Examiner* — Stephen Crow

(74) *Attorney, Agent, or Firm* — Cowan, Liebowitz & Latman, P.C.; Mark Montague

(57) ABSTRACT

A treadmill system, comprises: a sidewall member comprising a rim member extending around at least a portion of an upper edge of the sidewall member and a hatch member that provides access to an area enclosed by the sidewall member; a base member; a support pole member; a handle member coupled to the support pole member that extends from an upper portion of the support pole member and that is removably coupled to the rim member of the sidewall member; a rotatable platform member comprising an exercise surface, a peripheral sidewall and an interior sidewall, configured to rotate around the support pole member; and a particulate substrate disposed on the exercise surface. The exercise surface of the rotatable platform member is configured to evenly distribute the particulate substrate between the peripheral sidewall and the interior sidewall.

16 Claims, 1 Drawing Sheet

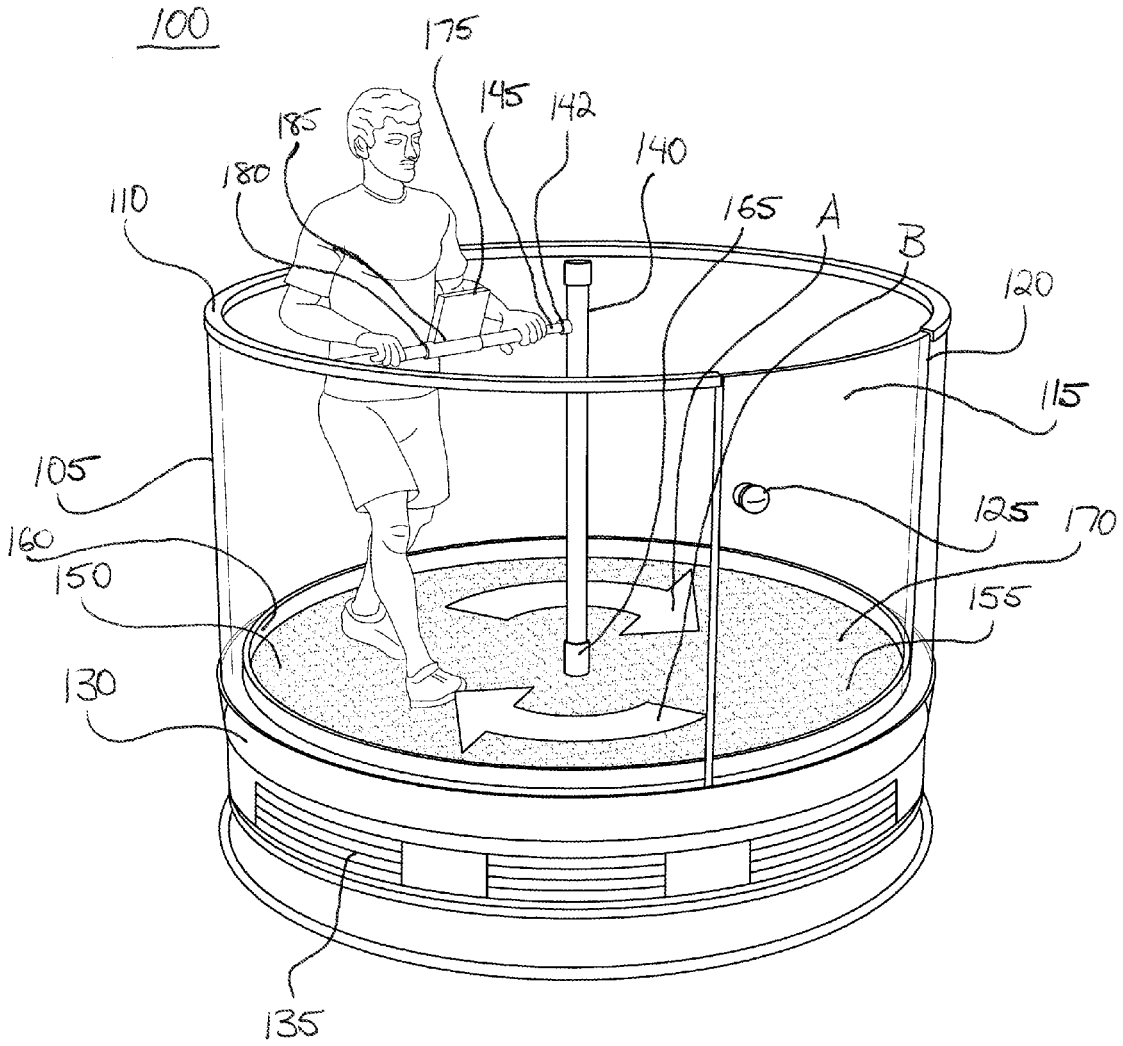
100
175
145
142
140
185
180
110
165
A
B
120
115
105
125
170
160
150
155
130
135

TREADMILL SYSTEM WITH ROTATABLE EXERCISE PLATFORM

REFERENCE TO RELATED APPLICATION

This application claims the benefit of U.S. Provisional Patent Application No. 62/001,410 filed with the U.S. Patent and Trademark Office on May 21, 2014, the entire content of which is incorporated herein by reference.

BACKGROUND

1. Field of the Invention

The present invention relates generally to a treadmill, and more particularly, to a treadmill including a rotatable exercise platform.

2. Description of Related Art

A treadmill is a machine used to simulate the acts of walking and running for the purpose of obtaining cardiovascular exercise. Treadmills are also used for physical therapy of the lower extremities. Distance runners, cross-trainers, and health conscious people seeking exercise often prefer to utilize treadmills to avoid high-impact of running on asphalt or other hard surfaces.

Treadmills allow a user to select the duration, speed and slope of an exercise regimen on their treadmill to be tailored to their specific needs. The treadmill also provides the user with a machine for obtaining exercise while indoors without concern for weather or other outdoor related inconveniences, such as crowded exercise facilities, traffic on streets, and inconsistent gradients of exercise surfaces. This allows the user to engage in cardiovascular exercise under controlled conditions without concern for the many obstacles present when attempting to exercise outdoors.

Traditional treadmills generally include a rubber belt driven by a motor to rotate around two rollers. A user walks or runs on a surface of the rubber belt as the rubber belt rotates. The surface of the rubber belt is typically supported by a rigid deck underneath the belt. The deck is constructed of a strong enough material to support the weight of a user. The deck below the rubber belt simulates the walking or running feel of asphalt or a track.

SUMMARY

Accordingly, an embodiment provides a treadmill system, comprising: a sidewall member comprising a rim member extending around at least a portion of an upper edge of the sidewall member and a hatch member that provides access to an area enclosed by the sidewall member; a base member coupled to a lower edge of the sidewall member; a support pole member disposed in a center of a diameter the sidewall member; a handle member coupled to the support pole member that extends from an upper portion of the support pole member and that is removably coupled to the rim member of the sidewall member; a rotatable platform member comprising an exercise surface, a peripheral sidewall and an interior sidewall, configured to rotate around the support pole member with a least a portion of the platform member disposed within the area enclosed by the sidewall member; and a particulate substrate disposed on the exercise surface of the rotatable platform member between the peripheral sidewall and the interior sidewall, wherein the exercise surface of the rotatable platform member is configured to evenly distribute the particulate substrate between the peripheral sidewall and the interior sidewall.

According to further embodiments: the peripheral sidewall is disposed along a peripheral edge of the rotatable platform member and the interior sidewall is disposed along an interior edge of the rotatable platform member; a height of the peripheral edge is greater than a height of the interior edge such that the exercise surface of the rotatable platform member is sloped towards the interior sidewall; the exercise surface comprises at least one of a planar surface and an arcuate surface; the exercise surface of the rotatable platform member comprises an arcuate surface extending across at least a portion of the exercise surface within which the particulate material is evenly distributed while the platform member rotates around the support pole member; the arcuate surface extends from the peripheral sidewall to the interior sidewall of the platform member; the peripheral sidewall of the platform member is disposed within the area enclosed by the sidewall member; the particulate substrate comprises at least one of sand, powder, gravel, rubber pellets, and foam articles; a height of each of the peripheral sidewall and the interior sidewall is at least twice a depth of the particulate substrate; and a height of the peripheral sidewall is at least one-quarter of a height of the sidewall member.

An additional embodiment provides a treadmill system, comprising: a sidewall member comprising a rim member extending around at least a portion of an upper edge of the sidewall member and a hatch member that provides access to an area enclosed by the sidewall member; a base member coupled to a lower edge of the sidewall member; a support pole member disposed in a center of a diameter the sidewall member; a handle member coupled to the support pole member that extends from an upper portion of the support pole member and that is removably coupled to the rim member of the sidewall member; a rotatable platform member comprising an exercise surface, a peripheral sidewall and an interior sidewall, configured to rotate around the support pole member with a least a portion of the platform member disposed within the area enclosed by the sidewall member; a particulate substrate disposed on the exercise surface of the rotatable platform member between the peripheral sidewall and the interior sidewall; and a computer removably coupled to the handle member, the computer comprising, a touch screen, a Universal Serial Bus (USB) connecting member and a Computer Processing Unit (CPU).

According to further embodiments: the CPU controls at least one of speed and duration of the rotation of the rotatable platform member and controls a slope of the rotatable platform member; the computer is removably coupled to the handle member by slidable insertion into a receiving member of a sleeve member, the sleeve member being slidably received by the handle member; the computer further comprises a camera sensor that senses a presence and absence of a user on the exercising surface, and wherein the CPU controls to stop the rotation of the rotatable platform member when the user is not sensed by the camera sensor; the CPU automatically controls a slope of the rotatable platform member to increase or decrease a height of the peripheral edge of the rotatable platform member based on a rotation speed of the rotatable platform member; and the particulate substrate comprises at least one of sand, powder, gravel, rubber pellets, and foam articles.

BRIEF DESCRIPTION OF THE DRAWINGS

The above and other aspects, features and advantages of certain embodiments will be more apparent from the following detailed description taken in conjunction with the accompanying drawing, in which:

FIG. 1 illustrates a treadmill system, according to an embodiment of the present invention.

DETAILED DESCRIPTION OF THE PRESENT INVENTION

The following detailed description of certain embodiments will be made in reference to the accompanying drawings. In the detailed description, explanation about related functions or constructions known in the art are omitted for the sake of clearness in understanding the concept of the invention, to avoid obscuring the invention with unnecessary detail.

FIG. 1 illustrates a treadmill system 100, according to an embodiment of the present invention. The treadmill system 100 includes a sidewall member 105. The sidewall member 105 may be constructed of transparent glass, plastic or other suitable material. A surface of the sidewall member 105 may be covered with a transparent tinting material or a plastic film including various illustrations, such as a beach or rain forest theme, according to a user's preference. The sidewall member 105 includes a rim member 110 extending around at least a portion of an upper edge of the sidewall member 105. The rim member 110 may be constructed of foam rubber, rubber, plastic, metal, or other suitable material. The rim member 110 covers the upper edge of the sidewall member 105, providing a user of the treadmill system 100 with an area for grasping with their hand to maintain stability while the treadmill system 100 is in operation or while the user enters or exits the treadmill 100.

The treadmill system 100 includes a hatch member 115 that provides access to an area enclosed by the sidewall member 105. The hatch member 115 may be coupled to the sidewall member 105 by hinges 120. The hatch member 115 may include a handle 125 disposed on a surface thereof. A user grasps the handle 125 in order to pull the hatch member 115 open. The hatch member 115 rotates about the hinges 120 outwardly away from the area enclosed by the sidewall member 105 when a user pulls on the handle 125. With the hatch member 115 open, the user is able to enter or exit the area enclosed by the sidewall member 105.

The treadmill system 100 includes a base member 130 rigidly coupled to a lower edge of the sidewall member 105. The base member 130 supports an entire circumference of the sidewall member 105. The base member 130 may be constructed of metal, metal alloy, plastic, or other suitable material. The base member 130 includes at least one vent 135 disposed around at least a portion of a side surface of the base member 135. The base member 130 may include multiple vents 135. The vent 135 allows heat to escape from within the base member 135.

The treadmill system 100 includes a support pole member 140. The support pole member 140 is disposed in a center of a diameter of each of the sidewall member 105 and the base member 130. The support pole member 140 may protrude up to substantially the same height as the sidewall member 105. A handle member 145 is coupled to the support pole member 140 by a hinge 142. The treadmill system 100 may include multiple handle members coupled to the rim member 110 and the support pole member 140. A second handle may be coupled to the support pole member by a second hinge and to the rim member 110 at a position diametrically opposed to the handle member 145. Additional handle members, e.g., greater than two handle members, may be equally distributed around the rim member 110 and the support pole member such that a circumference of the rim member 110 is divided into quarters, thirds, or other fraction. Multiple handle members allow multiple users to simultaneously walk and/or run on the treadmill system 100.

The hinge 142 may be a pivoting-type hinge that is rotatable in any direction, allowing the handle member 145 to rotate in a 360 degree hemisphere about the hinge 142. The handle member 145 extends from an upper portion of the support pole member 140. The handle member 145 is removably coupled to the rim member 110 of the sidewall member 105. The handle member 145 may be configured to be easily releasable from the rim member 110 so that if a user stumbles during operation of the treadmill system 100, the handle member 145 detaches from the rim member 110 upon light impact with the user and does not harm the user by being too rigidly connected to the rim member 110.

The handle member 145 may be grasped by the user during operation of the treadmill system 100 for stability. The user may unlock the handle member 145 from the rim member 110 and allow the handle member 145 to rest next to, i.e., in parallel with, the support pole member 140. In this configuration, the handle member 145 is no longer in the user's walking and/or running path.

The treadmill system 100 includes a rotatable platform member 150. The rotatable platform member includes an exercise surface 155, a peripheral sidewall 160 and an interior sidewall 165. The rotatable platform member 150 includes a support housing (not shown) upon which the rotatable platform member 150 rests. The support housing is coupled to, and supports the weight of, the rotatable platform member 150 and is configured to enable rotation of the rotatable platform member 150. For example, the support housing may include rigid metal scaffolding connecting the rotatable platform member 150 to an electric motor, as further described herein. The peripheral sidewall 160 is disposed along a peripheral edge of the rotatable platform member 150 and the interior sidewall 165 is disposed along an interior edge of the rotatable platform member 150. The peripheral sidewall 160 of the platform member 150 may be disposed entirely within the area enclosed by the sidewall member 105.

A height of the peripheral edge of the rotatable platform member 150 from the ground may be greater than a height of the interior edge of the rotatable platform member 150 from the ground such that the exercise surface 155 of the rotatable platform member 150 is sloped towards the interior sidewall 165. When the height of the peripheral edge of the rotatable platform member 150 is greater than the height of the interior edge of the rotatable platform member 150, the exercise surface 155 is embodied as a substantially conical shape. Due to the rotation of the rotatable platform member 150, the user may experience force tending to pull the user away from the support pole member 140. Configuring the exercise surface 155 as substantially conical in shape allows the user to lean slightly towards the support pole member 140, overcoming the force that pulls the user away from the support pole member 140.

The rotatable platform member 150 is configured to rotate around the support pole member 140. Rotation of the platform member 150 is powered by an electric variable speed motor (not shown) disposed within the base member 130 below the rotatable platform member 150. The electric motor is coupled to the support housing and rotates the rotatable platform member 150 around the support pole member 140, as indicated by arrows A and B, to provide motion below the user's feet. As the rotatable platform member 150 rotates, the user runs or walks with the motion of the rotatable platform member 150. At least a portion of the platform member 150 is disposed within the area enclosed by the sidewall member 105.

The treadmill system 100 further includes a particulate substrate 170 disposed on the exercise surface 155 of the rotatable platform member 150. The particulate substrate 170 includes at least one of sand, powder, gravel, rubber pellets, and foam articles. The particulate substrate 170 provides a surface on which the user can walk and/or run that is more effective for exercise and physical therapy of the user's joints, tendons and muscles. Walking and running on the particulate substrate 170 results in the user's feet sinking into the particulate substrate 170, increasing the amount of muscle effort to walk and run. Thus, a user of the treadmill system 100 has an improved exercise experience when running or walking on the particulate substrate 170.

The exercise surface 155 of the rotatable platform member 150 is configured to evenly distribute the particulate substrate 170 between the peripheral sidewall 160 and the interior sidewall 165. The exercise surface 155 may be embodied as at least one of a planar surface and an arcuate surface. When the exercise surface 155 of the rotatable platform member 150 is embodied as the arcuate surface, the particulate material 170 is evenly distributed throughout the exercise surface 155 while the platform member 150 rotates around the support pole member 140. The curvature of the arcuate surface may extend from the peripheral sidewall 160 to the interior sidewall 165 of the platform member 150. The curvature of the arcuate surface refers to curvature of a radius of the exercise surface 155, the radius extending from the peripheral sidewall 160 to the interior sidewall 165.

A trough of the arcuate surface may be disposed in a center of the exercise surface 155 between the peripheral sidewall 160 and the interior sidewall 165. The trough of the arcuate surface is where the particulate material 170 will collect while the user walks and/or runs on the exercise surface 155. As the user walks and/or runs on the exercise surface 155, the user's feet may tend to throw the particulate material 170 away from the center of the exercise surface 155. When the exercise surface 155 is embodied as the arcuate surface, the particulate material will return from the peripheral edge of the exercise surface 155 towards the center of the exercise surface 155.

A height of each of the peripheral sidewall 160 and the interior sidewall 165 may be at least twice a depth of the particulate substrate 170. The height of each of the peripheral sidewall 160 and the interior sidewall 165 may also be at least three times, four times, five times, or up to ten times the depth of the particulate substrate 170. The height of the peripheral sidewall 160 and the interior sidewall 165 may be substantially the same height as the sidewall member 105. The height of the peripheral sidewall 160 and the interior sidewall 165 may also be one-quarter, one-third, one-half, two-thirds, or three-quarters, the height of the sidewall member 105. That is, the height of the peripheral sidewall 160 and the interior sidewall 165 of the platform member 150 is configured to be sufficiently high so that the particulate material 170 does not leave the area enclosed by the sidewall member 105 while the user is walking and/or running on the exercise surface 155.

Periodically, the particulate substrate 170 may need to be replaced with clean substrate. To facilitate removal of the particulate substrate 170, the sidewall member 105 may be removed from the base member 130 and the rotatable platform member 150 may be removed from the support housing. The rotatable platform member 150 may be lifted over the support pole member 140. The rotatable platform member 150 may then be tipped over in order to discard soiled substrate. New substrate is then filled onto the exercise surface 155 of the rotatable platform member 150 and the rotatable platform member 150 is re-coupled to the support housing and the sidewall member 105 is re-coupled to the base member 130.

The treadmill system 100 includes a computer 175 removably coupled to the handle member 145. The computer 175 may be removably coupled to the handle member 150 by a sleeve member 180. The sleeve member 180 is slidably received by the handle member 145 and the computer 175 is inserted into a receiving member 185. The computer 175 includes a touch screen, a Universal Serial Bus (USB) connecting member and a Computer Processing Unit (CPU). The computer 175 may be a tablet, mobile device, PDA, laptop, or other suitable device. Using the computer 175, the user is able to select the speed and duration of the rotation of the rotatable platform 150 on the touch screen. The CPU receives the user's selection and controls at least one of speed and duration of the rotation of the rotatable platform member 150 by controlling the operation of the electric motor. The computer 175 may be connected to the electrical motor by a wired connection. The computer 175 may also include a wireless transceiver that transmits and receives signals by, for example, WiFi or Bluetooth, to the electric motor, thus, controlling the electric motor without a wired connection.

The computer 175 may include a camera sensor that senses the presence and absence of the user on the exercising surface 155. As a safety feature, the computer 175 may stop the rotation of the rotatable platform member 150 when the user is not sensed by the camera sensor. The computer 175 may also communicate with electrodes, either through a wired or wireless connection, disposed within the handle member 145. The electrodes disposed within the handle member 145 sense the presence and absence of the user's hands. The computer 175 may stop the rotation of the rotatable platform member 150 when the user is not sensed by the electrodes.

A slope of the rotatable platform member 150 may be selected by the user on computer 175. The user may select an increase or decrease in the slope of the rotatable platform member 150 by increasing the height of the peripheral edge of the rotatable platform member 150 such that the exercise surface 155 of the rotatable platform member 150 is sloped towards the interior sidewall 165. As described above, when the height of the peripheral edge of the rotatable platform member 150 is greater than the height of the interior edge of the rotatable platform member 150, the exercise surface 155 is embodied as a substantially conical shape. The computer 175 may automatically increase the height of the peripheral edge of the rotatable platform member 150 as the rotation speed of the rotatable platform member 150 increases to allow the user to lean slightly towards the support pole member 140 and overcome the force pulling the user away from the support pole member 140.

The treadmill system 100, as described herein, provides a machine by which a user can engage in cardiovascular exercise and/or physical therapy of the lower extremities while walking and/or running. The user's exercise and/or physical therapy is enhanced by the treadmill system 100 because the treadmill system 100 is configured to allow the user to walk and/or run on various particulate substrates as opposed to one type of hard exercise surface. The various particulate substrates described herein require the user to exert more energy and utilize different muscles, tendons, and ligaments while walking and/or running on the treadmill system 100 than on asphalt or other hard surfaces.

While embodiments of the invention have been shown and described with reference to certain embodiments thereof, it will be understood by those skilled in the art that various changes in form and details may be made therein without departing from the spirit and scope of the invention as defined by the appended claims and equivalents thereof.

The invention claimed is:

1. A treadmill system, comprising:

a sidewall member comprising a rim member extending around at least a portion of an upper edge of the sidewall member and a hatch member that provides access to an area enclosed by the sidewall member;

a base member coupled to the sidewall member;

a support pole member disposed in a center of a diameter the sidewall member;

a handle member coupled to the support pole member that extends from an upper portion of the support pole member and that is removably coupled to the rim member of the sidewall member;

a rotatable platform member comprising an exercise surface, a peripheral sidewall and an interior sidewall, configured to rotate around the support pole member with a least a portion of the platform member disposed within the area enclosed by the sidewall member; and a particulate substrate disposed on the exercise surface of the rotatable platform member between the peripheral sidewall and the interior sidewall, wherein the exercise surface of the rotatable platform member is configured to distribute the particulate substrate between the peripheral sidewall and the interior sidewall.

2. The treadmill system according to claim 1, wherein the peripheral sidewall is disposed along a peripheral edge of the rotatable platform member and the interior sidewall is disposed along an interior edge of the rotatable platform member.

3. The treadmill system according to claim 2, wherein a height of the peripheral edge is greater than a height of the interior edge such that the exercise surface of the rotatable platform member is sloped towards the interior sidewall.

4. The treadmill system according to claim 2, wherein the exercise surface comprises at least one of a planar surface and an arcuate surface.

5. The treadmill system according to claim 1, wherein the exercise surface of the rotatable platform member comprises an arcuate surface extending across at least a portion of the exercise surface within which the particulate material is evenly distributed while the platform member rotates around the support pole member.

6. The treadmill system according to claim 5, wherein the arcuate surface extends from the peripheral sidewall to the interior sidewall of the platform member.

7. The treadmill system according to claim 1, wherein the peripheral sidewall of the platform member is disposed within the area enclosed by the sidewall member.

8. The treadmill system according to claim 1, wherein the particulate substrate comprises at least one of sand, powder, gravel, rubber pellets, and foam articles.

9. The treadmill system according to claim 1, wherein a height of each of the peripheral sidewall and the interior sidewall is at least twice a depth of the particulate substrate.

10. The treadmill system according to claim 1, wherein a height of the peripheral sidewall is at least one-quarter of a height of the sidewall member.

11. A treadmill system, comprising:

a sidewall member comprising a rim member extending around at least a portion of an upper edge of the sidewall member and a hatch member that provides access to an area enclosed by the sidewall member;

a base member coupled to the sidewall member;

a support pole member disposed in a center of a diameter the sidewall member;

a handle member coupled to the support pole member that extends from an upper portion of the support pole member and that is removably coupled to the rim member of the sidewall member;

a rotatable platform member comprising an exercise surface, a peripheral sidewall and an interior sidewall, configured to rotate around the support pole member with a least a portion of the platform member disposed within the area enclosed by the sidewall member;

a particulate substrate disposed on the exercise surface of the rotatable platform member between the peripheral sidewall and the interior sidewall; and a computer removably coupled to the handle member, the computer comprising a touch screen, a Universal Serial Bus (USB) connecting member and a Computer Processing Unit (CPU).

12. The treadmill system according claim 11, wherein the CPU controls at least one of speed and duration of the rotation of the rotatable platform member and controls a slope of the rotatable platform member.

13. The treadmill system according claim 11, wherein the computer is removably coupled to the handle member by slidable insertion into a receiving member of a sleeve member, the sleeve member being slidably received by the handle member.

14. The treadmill system according claim 11, wherein the computer further comprises a camera sensor that senses a presence and absence of a user on the exercising surface, and wherein the CPU controls to stop the rotation of the rotatable platform member when the user is not sensed by the camera sensor.

15. The treadmill system according claim 11, wherein the CPU automatically controls a slope of the rotatable platform member to increase or decrease a height of the peripheral edge of the rotatable platform member based on a rotation speed of the rotatable platform member.

16. The treadmill system according to claim 11, wherein the particulate substrate comprises at least one of sand, powder, gravel, rubber pellets, and foam articles.

* * * * *